US005954065A

United States Patent [19]

Silva

[11] Patent Number: 5,954,065

[45] Date of Patent: Sep. 21, 1999

[54] HAIR SEWING FASTENER

[76] Inventor: David Alan Silva, 632 Loma Prieta Dr., Aptos, Calif. 95003

[21] Appl. No.: 09/186,552

[22] Filed: Nov. 5, 1998

[51] Int. Cl.[6] ..... A45D 8/04; A45D 8/12; A44B 21/00; A45F 5/02

[52] U.S. Cl. ..... 132/273; 132/275; 24/3.13; 24/3.1

[58] Field of Search ..... 132/273, 275, 132/128, 281, 101, 248, 251; 24/3.13, 3.1, 300, 58, 712

[56] References Cited

U.S. PATENT DOCUMENTS

| | | | |
|---|---|---|---|
| 3,037,515 | 6/1962 | Dietze | 132/42 |
| 3,403,427 | 10/1968 | Asseo et al. | 24/73 |
| 5,036,870 | 8/1991 | Edmark | 132/273 |
| 5,199,135 | 4/1993 | Gold | 24/16 R |
| 5,289,834 | 3/1994 | Lawrence | 132/273 |
| 5,806,538 | 9/1998 | Keltner | 132/273 |
| 5,832,938 | 11/1998 | Ybarra | 132/273 |

FOREIGN PATENT DOCUMENTS

| | | | |
|---|---|---|---|
| 1100757 | 9/1955 | France | 401/8 |
| 2276542 | 5/1994 | United Kingdom | 132/273 |

*Primary Examiner*—John J. Wilson
*Assistant Examiner*—Robyn Doan

[57] ABSTRACT

A method and apparatus for sewing hair comprising: Selecting an eyeless needle hair sewing fastener. Each eyeless needle is narrow on one end and wider at the other. A resilient band is secured to the narrow end of the needle and slid up its shaft until snug at the wider end. The needle is then placed into hair. The free end of the band is put onto the needle tip and the needle is pulled through the band and sewn through the hair. Finally the needle is placed into the user's hair to secure. Whereby a person's hair is sewn and the device is easily removable and reusable.

3 Claims, 2 Drawing Sheets

HAIR SEWING FASTENER

BACKGROUND OF THE INVENTION

1. Field of the Invention

The present invention and method relates to a hair sewing fastener.

2. Description of Prior Art

Many people like to put their hair up in various styles. One way to put the hair up is to have a professional hair-stylist sew the hair into an upswept style by using a traditional needle and thread. This process is affective but only lasts a short period of time until the wearer has to cut the thread from the hair. This technique is temporary, time consuming, and costly.

SUMMARY OF THE PRESENT INVENTION

An object of the present invention is to provide an instrument which is convenient, practical, and inexpensive for use in hair sewing and styling.

A further object is to provide such an instrument that can be used unassisted by the individual styling their hair, eliminating the expense of a professional stylist.

A further object is to provide an instrument that can be reused over and over again.

A further object is to provide an instrument that will quickly hold the users hair up in a neatly sewn style.

A further object is to provide a hair sewing fastener wherein a needle doesn't have to be threaded and tied before use.

A further object is to provide a hair sewing fastener where a needle portion is secured into the users hair, after sewing, eliminating the process of cutting the needle off the band and tying the band to the hair as one does with traditional hair sewing.

According to one aspect of the present invention, there is provided a hair sewing fastener comprising a tiny resilient band just a little bigger than the needle's tip) attached to a larger band, and an eyeless needle portion in the shape of a long, narrow triangle or cone shape with a rounded tip to prevent puncturing the skin of the user.

According to the arrangement described above the tiny resilient band is placed on the tip of the needle and slid up its shaft until it is snug at the other end. Because the band is resilient, when it is placed on the tip it can still stretch as it travels up the needle until snug at the other end. By eliminating the process of having to thread an eye of a traditional needle, the current invention allows the user to remove the sewn portion easily by sliding the band off the needle. A traditional needle can't be reversed out of a sewn style making the sewed portion usable only once until cut out of the hair. Further, sliding the band off the needle allows it to be easily removed and reused. Therefore, the current invention eliminates the traditional process of tying the band to the hair; it eliminates cutting the needle out of the hair; it eliminates tying the band's end to the hair after sewing; and finally it substitutes what was once a temporary time-consuming sewing process with a device that can be simply used by a nonhair-stylist and that can conveniently be reused over and over again.

Accordingly a preferred embodiment of the present invention the eyeless needle is shaped in a long, narrow triangle or cone shape narrow on one end and wider on the other. The narrow end is rounded instead of sharp so the needle can be left in the users hair with out harming them. The resilient band is round in diameter and has a first tiny band with an opening the size of the needle's tip attached to a long band for sewing.

Other objects, features and advantages of the present invention will become apparent from the following description of the preferred embodiments given with reference to the accompanying drawings.

DETAILED DESCRIPTION OF THE PREFERRED EMBODIMENTS

Figure 1:
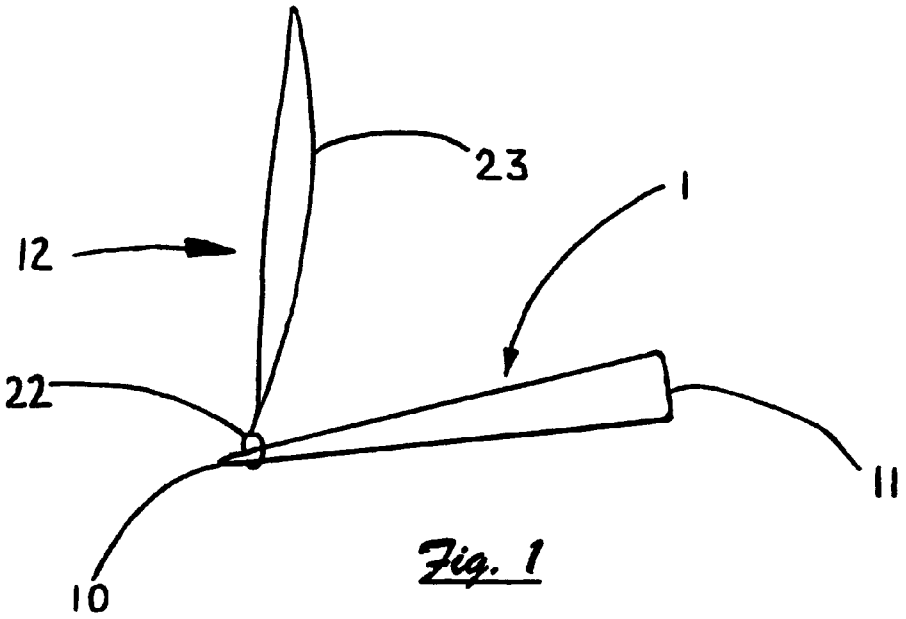
FIG. 1 is a plan view showing the hair sewing needle and the hair sewing band according to the present invention. The band is placed on the narrow end of the needle.
Figure 2:
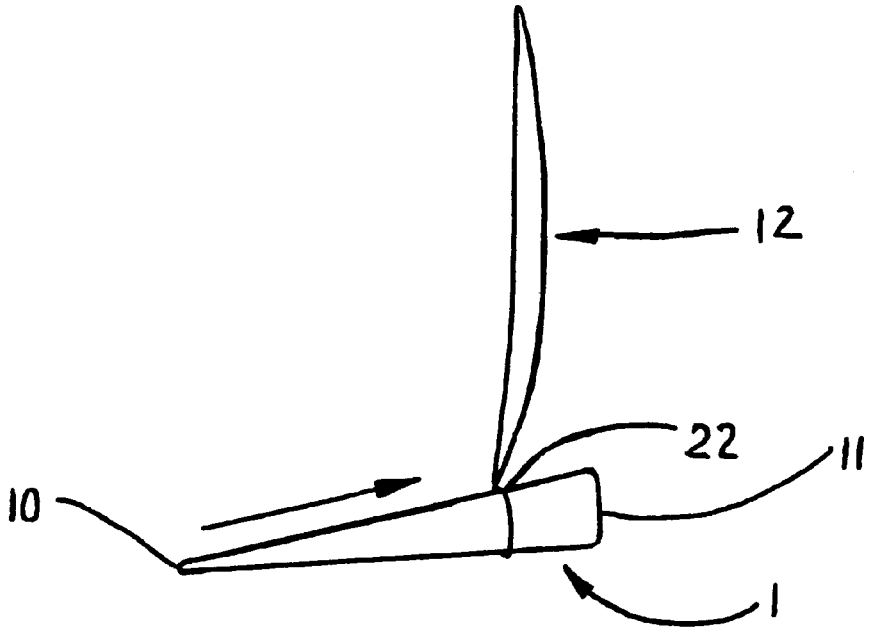
FIG. 2 is a plan view showing the band snug to the wider end of the needle after being slid up the needle's shaft.

Referring to FIGS. 1 through 7 of the accompanying drawings. There is illustrated a hair sewing method and fastener embodying the present invention. The needle generally designated by reference numeral 1, comprises a first needle end 10 and a second needle end 11. The resilient band generally designated by reference numeral 12, comprises a first band portion 22 and a second band portion 23. In this embodiment, the needle portion 1, is made of plastic or wood and the band portion 12 is made of some type of resilient thread such as elastic.

To secure the band to the needle (FIG. 1) and (FIG. 2) the user places the band 22 onto the needle tip 10. The user then slides the band 22 up the needle shaft toward the needle end 11. The band 22 slides up the shaft until it is snug to the needle.

Figure 3:
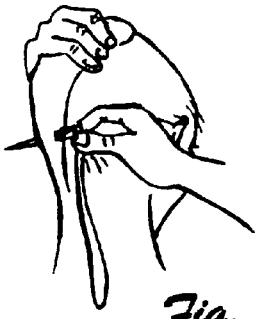
FIG. 3 is a schematic view of the needle placed in hair.
Figure 4:
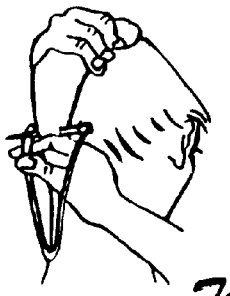
FIG. 4 is a schematic view showing the free end of the larger band being placed onto the needle's tip.
Figure 5:
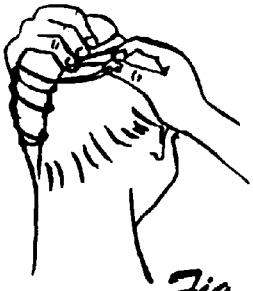
FIG. 5 is a schematic view of the needle and band being sewn through the hair.
Figure 6:
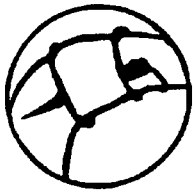
FIG. 6 is a schematic view of the needle secured in hair.
Figure 7:
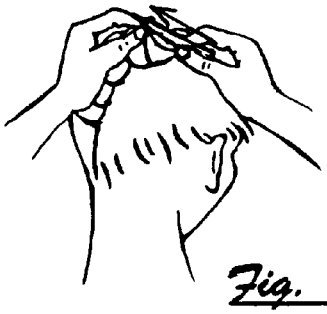
FIG. 7 is a schematic view of the band being removed from the needle.

In use of the hair sewing needle described above the needle portion 1 is held by the user and placed into the user's up-swept hair and left in place (FIG. 3). The free end of the band 23 is put onto the needle's end 10 (FIG. 4). The needle is then pulled through the band 23 and sewn through the hair (FIG. 5). When the band 23 is completely sewn the needle 1 is placed into the user's hair to secure (FIG. 6). To remove the present invention the user pulls the band 22 off of the needle 1 (FIG. 7) and pulls the band out of the hair.

Figure 8:
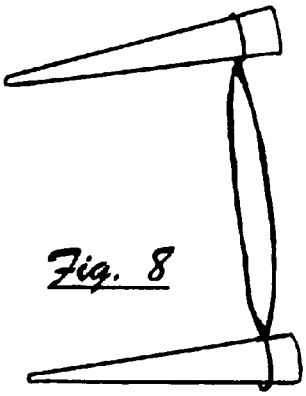
FIG. 8 is a plan view of another embodiment of the present invention.

The present invention being thus described, it is obvious that the same may be varied in many ways. For instance, the needle portions of FIG. 1 can be of different shapes as long as it is tapered and will smoothly move through the user's hair without interruption and won't allow the band to slide off the wide end. Further, the band can have an additional tiny band attached to an additional needle at the opposite end (FIG. 8). Such variations are not to be regarded as a departure from the spirit and scope of the invention, and all such variations as would be obvious to those skilled in the art are intended to be included within the scope of the following claims.

I claim:

1. A method of securing hair comprising:

selecting a hair sewing fastener comprising:

an eyeless needle narrow on one end and wider at the other, with a resilient band secured to the narrow end of said needle and slid up the shaft until snug at the wider end of said needle;

placing said needle into hair;

placing a free end of said band onto said narrow end of said needle;

pulling said needle through said band;

sewing said needle and said band through hair;

securing said needle into hair;

whereby a person's hair is sewn and said needle and said band are easily removable and reusable.

2. A method of securing hair comprising:

selecting a hair sewing fastener comprising:

two eyeless needles narrow on one end and wider at the other, with a resilient band secured to the narrow ends of said needles and slid up the shaft of said needles until snug at the wider end of said needles;

placing said first needle into hair and leaving it in place;

sewing said second needle and said band through hair;

placing said second needle into hair to secure;

whereby a person's hair is sewn and said needles and said band are easily removable and reusable.

3. A hair sewing fastener comprising:

two eyeless needles narrow and rounded on one end and wider on the other; and a long resilient band with two smaller resilient bands attached to each end of said long band, wherein said small bands are placed onto each said narrow end of said needles and slid up the shaft of said needles until snug at said wider end of said needles.

* * * * *